US012687105B2

(12) United States Patent
Al-Ghamdi et al.

(10) Patent No.: US 12,687,105 B2
(45) Date of Patent: Jul. 21, 2026

(54) WIRELINE LOGGING IN HORIZONTAL WELLS

(71) Applicant: SAUDI ARABIAN OIL COMPANY, Dhahran (SA)

(72) Inventors: Ahmed Al-Ghamdi, Al Khobar (SA); Hisham Al-Daroura, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 286 days.

(21) Appl. No.: 18/530,089

(22) Filed: Dec. 5, 2023

(65) Prior Publication Data

US 2025/0179914 A1 Jun. 5, 2025

(51) Int. Cl.

| | |
|---|---|
| ***E21B 47/13*** | (2012.01) |
| ***E21B 23/04*** | (2006.01) |
| ***E21B 47/08*** | (2012.01) |
| ***E21B 47/09*** | (2012.01) |

(52) U.S. Cl.

CPC ..... *E21B 47/13* (2020.05); *E21B 23/0413* (2020.05); *E21B 47/08* (2013.01); *E21B 47/09* (2013.01)

(58) Field of Classification Search

CPC ..... E21B 47/13; E21B 23/0413; E21B 47/08; E21B 47/09; E21B 23/14; E21B 47/00

See application file for complete search history.

(56) References Cited

U.S. PATENT DOCUMENTS

| | | | | |
|---|---|---|---|---|
| 3,798,966 | A * | 3/1974 | Planche | G01V 3/20 181/102 |
| 4,524,272 | A * | 6/1985 | Paap | E21B 47/11 250/266 |
| 6,385,132 | B1 * | 5/2002 | Sackett | G01V 1/16 367/188 |
| 6,951,262 | B2 | 10/2005 | West | |
| 7,954,563 | B2 | 6/2011 | Mock et al. | |
| 2002/0060095 | A1 * | 5/2002 | Wentworth | E21B 17/046 175/398 |
| 2003/0024710 | A1 * | 2/2003 | Post | E21B 23/0411 166/66.4 |
| 2015/0068737 | A1 * | 3/2015 | Ash | E21B 23/14 166/250.01 |
| 2018/0010407 | A1 * | 1/2018 | Jaaskelainen | E21B 33/14 |
| 2018/0258733 | A1 | 9/2018 | Ostertag | |
| 2020/0049481 | A1 * | 2/2020 | Harrigan | E21B 47/085 |

FOREIGN PATENT DOCUMENTS

WO 2021007430 A1 1/2021

* cited by examiner

*Primary Examiner* — Amine Benlagsir
(74) *Attorney, Agent, or Firm* — Vorys, Sater, Seymour and Pease LLP

(57) ABSTRACT

A wellbore logging system includes a wireline extending into a wellbore, a sonde including at least one logging instrument, a canopy coupled to the sonde and an actuator operable to move the canopy from a retracted configuration to a radially extended configuration. The canopy includes a central shaft, a plurality of ribs pivotally coupled to the central shaft, and a plurality of flexible panels extending between each of the plurality of ribs to circumscribe the central shaft. A carrier fluid may be pumped against the canopy in the radially extended configuration to advance the sonde along inclined and horizontal portions of a wellbore.

13 Claims, 4 Drawing Sheets

WIRELINE LOGGING IN HORIZONTAL WELLS

FIELD OF THE DISCLOSURE

The present disclosure relates generally to subterranean tools and methods for assessing geologic formations and wellbore conditions and, more particularly, to the use of wireline logging tools in horizontal or inclined (deviated) portions of a wellbore.

BACKGROUND OF THE DISCLOSURE

Wellbores may be drilled to recover natural deposits of oil and gas, as well as other desirable materials that are trapped in subterranean geological formations. Often a logging tool is deployed in the wellbore to collect data related to one or more properties of the wellbore, and/or the geologic formation penetrated by the wellbore, as a function of depth. The data is compiled into a wellbore log, which is often used as the primary means for determining formation depth, oil in place and many other pieces of critical information.

One of the quickest and most efficient types of wellbore logging is wireline logging in which a sonde (generally a long metallic cylinder that can be up to 90 feet long and include a variety of instruments) is lowered into the wellbore on an electrical cable or wireline. The sonde may take measurements and send associated signals up the wireline to a surface location for analysis by geologists and engineers. The position of the sonde in the wellbore may be controlled by a winch at the surface that winds and unwinds the wireline to raise and lower the sonde. Gravity may be relied upon to carry the sonde downhole through vertical portions of the wellbore, but another mechanism must be employed to drive the sonde through inclined or horizontal portions. The wireline lacks sufficient stiffness to push the sonde along these portions, so some sondes employ tractors or crawlers to drag or push the sonde downhole. These tractors may be slow and unreliable, and thus, other mechanisms to deploy a wireline logging tool along a horizontal portion of a wellbore would be useful.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellbore logging system includes a wireline extending from a surface location into a wellbore, a sonde coupled the wireline in the wellbore, the sonde including at least one logging instrument for detecting one or more properties of the wellbore or a geologic formation penetrated by the wellbore, as a function of depth and a canopy coupled to the sonde. The canopy includes a central shaft, a plurality of ribs pivotally coupled to the central shaft, a plurality of flexible panels extending between each of the plurality of ribs to circumscribe the central shaft and an actuator operably coupled to the wireline and the plurality of ribs, the actuator responsive to a signal transmitted through the wireline to move the plurality of ribs from a retracted configuration to a radially extended configuration with respect to the central shaft.

According to another aspect, a method of conducting a logging operation in a wellbore includes (a) lowering a logging tool on a wireline through a vertical portion of the wellbore, (b) transmitting a command signal through the wireline to the logging tool in the wellbore, (c) radially extending a canopy of the logging tool in response to the command signal and (d) pumping a carrier fluid into the wellbore to impinge on the canopy and thereby advance the logging tool along an inclined or horizontal portion of the wellbore.

According to still another aspect of the disclosure, a logging tool includes a sonde including a connector for coupling the sonde to a wireline, the sonde operable to detect one or more properties of the wellbore or a geologic formation penetrated by the wellbore, as a function of depth, a central shaft fixedly coupled to the sonde, a plurality of ribs pivotally coupled to the central shaft, a plurality of flexible panels extending between each of the plurality of ribs to circumscribe the central shaft and an actuator operably coupled to the plurality of ribs to move the plurality of ribs from a retracted configuration to a radially extended configuration with respect to the central shaft.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
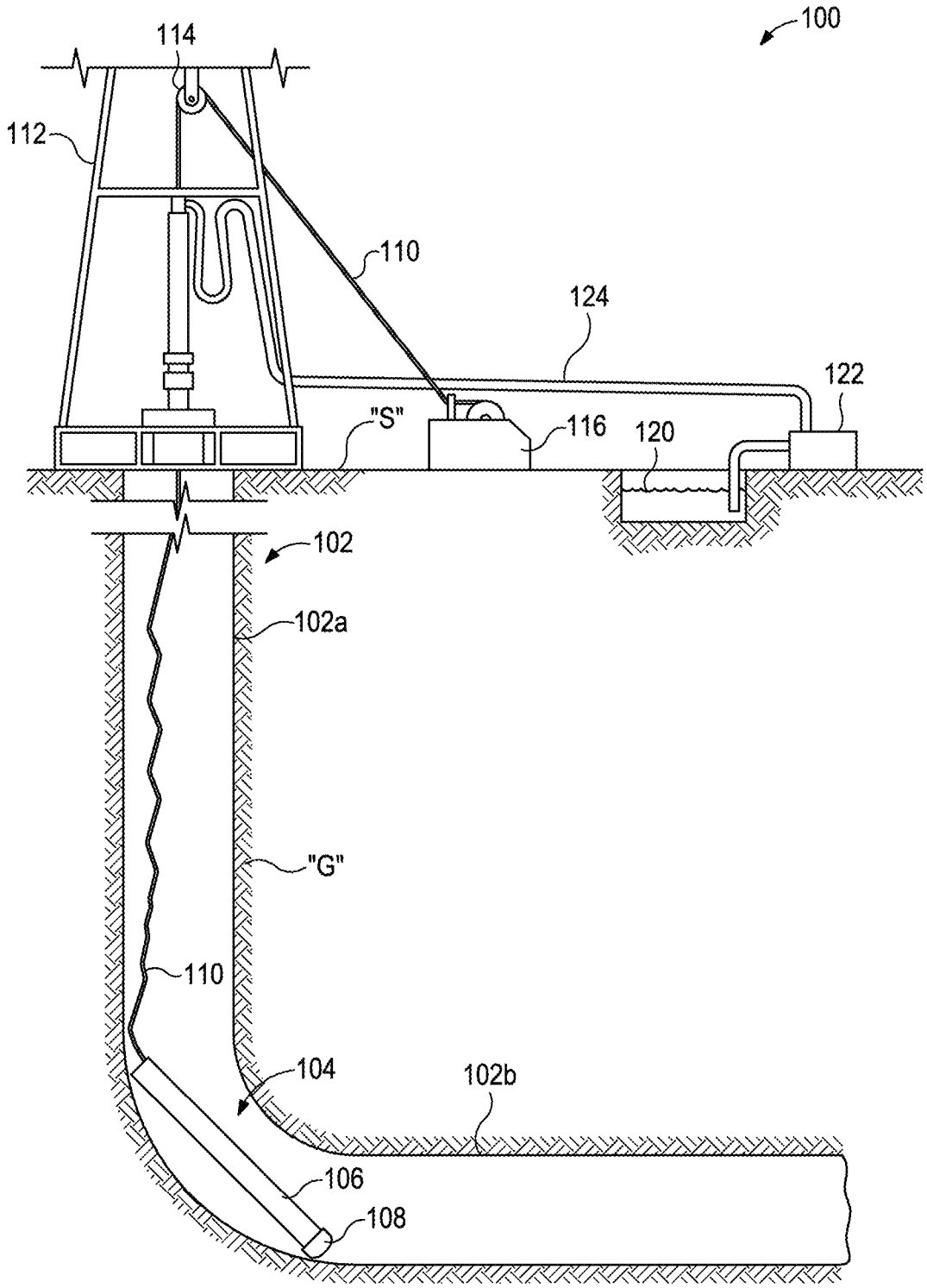
FIG. 1 is a schematic diagram of an example well system including a wireline logging tool with an extendable canopy in accordance with aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a wireline logging tool with a selectively extendable canopy. The canopy may be extended once the logging tool has reached a location in a wellbore where gravity alone is insufficient to advance the logging tool downhole. A carrier fluid, e.g., diesel or water, may be pumped down the wellbore to impinge on the extended canopy and advance the logging tool downhole. The canopy may be constructed with a plurality of ribs pivotally coupled to a central shaft and flexible elastomeric panels extending between the ribs. A piston may be advanced or retracted along the shaft by an electric motor or other mechanism powered through the wireline to extend and retract the canopy. In the extended configuration, wheels supported at free ends of the ribs may guide the wireline logging tool along inner walls of wellbore while a caliper provides measurements of the distance the ribs have extended to give an indication of the diameter of the wellbore. Ports defined through the panels of the canopy may allow a portion of the carrier fluid to pass through the canopy. Monitoring the carrier fluid passing through the canopy may assist in the identification of obstructions forward of logging tool.

FIG. 1 is a schematic diagram of an example well system 100 that may employ one or more of the principles of the present disclosure, according to one or more embodiments. As depicted, the well system 100 includes a wellbore 102 that extends from a surface location "S" through a subterranean geologic formation "G." Wellbore 102 extends from a terrestrial surface location "S," but aspects of the present disclosure may be also practiced in offshore and subsea wellbores without departing from the scope of the disclosure. Wellbore 102 includes a generally vertical portion 102*a* that transitions to a generally horizontal portion 102*b*. Aspects of the present disclosure may also be practiced in wellbores extending along other trajectories including deviated trajectories with any inclination between 0 degrees and 90 degrees with respect to a vertical orientation. A logging tool 104 is provided in the wellbore 102 for the collection of data related to the wellbore 102 and the geologic formation "G." The logging tool 104 generally includes a sonde 106 that houses instruments, communication equipment and other devices, and a selectively extendable canopy 108 that may assist in advancing the logging tool 104 downhole as described in greater detail below.

The logging tool 104 may be coupled to a wireline 110 at a connector defined (or provided) on the sonde 106. The wireline 110 extends to the surface location "S" and may be employed to raise (convey uphole) and lower (convey downhole) the logging tool 104. Also, the wireline is operable to transmit data, instructions (command signals) and electrical power between the surface location "S" and the logging tool 104 within the wellbore 102. To support the wireline 110, well system 100 includes a derrick 112 supporting a pulley 114 over the wellbore 102. In some wireline operations, an arrangement of cables, cranes and other equipment (not shown) may substitute for the derrick 112. The pulley 114 guides the wireline 110 out of the wellbore 102 to a winch 116. The winch 116 may be operated to wind and unwind the wireline 110 to respectively raise and lower the logging tool 104 in the wellbore 102. The wireline 110 may be constructed as a thin electrically-conductive cable devoid of any fluid transmission conduits therein. In other embodiments, other types of conveyances, such as slickline or coiled tubing, may be employed to raise and lower the logging tool 104 without departing from the scope of the disclosure.

As illustrated in FIG. 1, the logging tool 104 has been lowered to a bottom of the vertical portion 102*a* of the wellbore 102. Due to the flexibility of the wireline 110, further unwinding of the wireline 110 from the winch 116 may create slack in the wireline 110, but is unable to further advance the logging tool 104 into the horizontal portion 102*b*. To advance the logging tool 104 further downhole, a carrier fluid 120, e.g., water or diesel, may be pumped into the wellbore 102. The canopy 108 may be extended (see FIG. 2B), such that the carrier fluid 120 impinges against the canopy 108 and hydraulically impels the logging tool 104 to advance in a downhole direction. The carrier fluid 120 can be pumped downhole by pump 122 fluidly coupled to the wellbore 102 through a surface conduit 124. As the carrier fluid 120 advances the logging tool 104, downhole fluids displaced by the carrier fluid 120, e.g., fluids downhole of the logging tool 104 may be injected into (received within) the geologic formation "G."

Figure 2A:
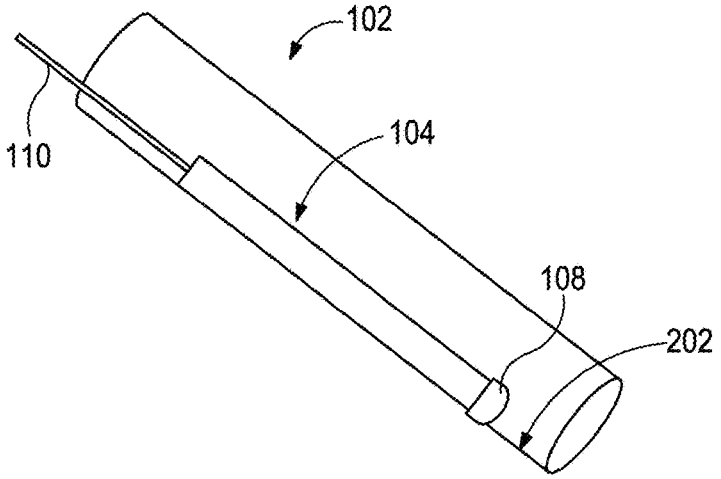
FIGS. 2A through 2C are schematic views of the wireline logging tool in sequential operational stages in which the canopy of FIG. 1 is extended and retracted within inclined and horizontal portions of the wellbore.
Figure 2B:
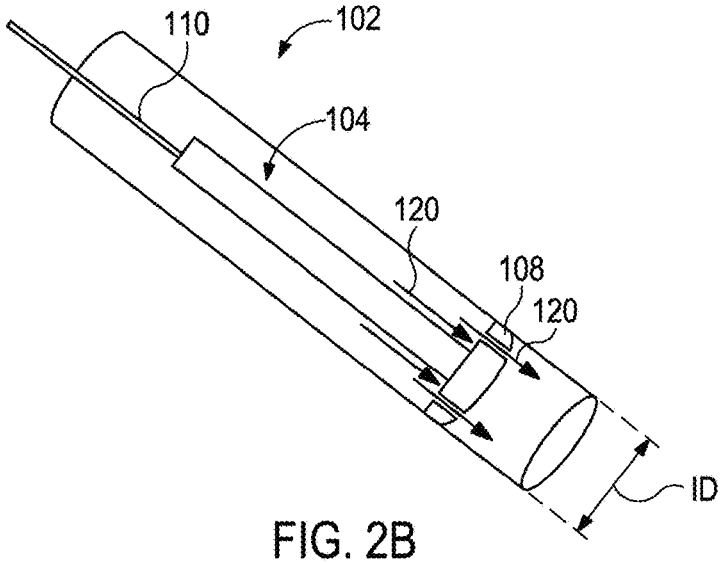
Figure 2C:
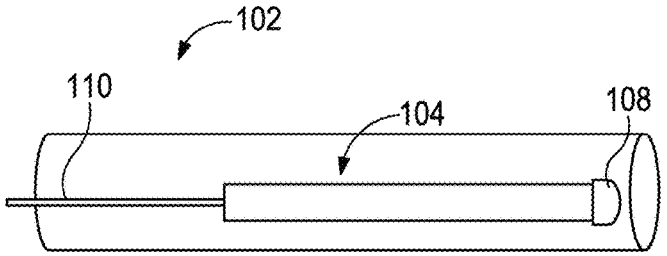

FIGS. 2A, 2B and 2C are schematic views of the wireline logging tool 104 in sequential operational stages. As illustrated in FIG. 2A, the logging tool 104 is deployed into the wellbore 102 with the canopy 108 in a retracted or closed configuration. The logging tool 104 may be lowered by gravity, e.g., by simply unwinding the wireline 110 from the winch 116 (FIG. 1), until the logging tool 104 reaches a location where the inclination of the wellbore 102 is insufficiently steep for gravity to carry the logging tool 104 further downhole. In some embodiments, an inclination of about 45 degrees from vertical may be insufficiently steep for gravity to overcome the frictional contact of the logging tool 104 resting on an inner wall 202 of the wellbore 102 and carry the logging tool 104 further downhole. In some embodiments, the wall 202 may be open hole such that the logging tool 104 engages the geologic formation "G" (FIG. 1), which may be relatively rough, and in other embodiments, the wall 202 may include casing (see FIG. 3B), which may be relatively smooth. Thus, casing may permit delivery the logging tool 104 to be locations with shallower inclinations than in similar open-hole wellbores.

As illustrated in FIG. 2B, the canopy 108 may be extended to an open position to facilitate further advancement of the logging tool 104. The canopy 108 may be extended in response to an electrical signal transmitted through the wireline 110, as described in greater detail below. Once the canopy 108 is extended, the carrier fluid 120 may be gradually pumped down the wellbore 102 to impinge on the canopy 108, and apply a downhole force to the logging tool 104. The downhole force may thereby assist in quickly and efficiently advancing the logging tool 104 to its destination.

Ports 204 defined through the canopy 108 may allow a portion of the carrier fluid 120 to pass through (traverse) the canopy 108. Permitting passage of the carrier fluid 120 through the canopy 108 may allow injectivity of fluid into the geologic formation "G" (FIG. 1) below (downhole of) the logging tool 104. Thus, the pumping pressure, e.g., the resistance to the flow of the carrier fluid 120, may be monitored along with the speed of the logging tool for any abnormal patterns that may be indicative of obstructions in the wellbore 102. A sudden increase in pumping pressure may indicate a reduction of flow area ahead (downhole of or below) the logging tool 104. For example, if the wellbore 102 is cased, it will define a fixed inner diameter ID and any observed increases in pumping pressure associated with a loss of movement of the logging tool 104 may indicate that the casing has structural damage that is blocking the path for the injected fluid and increasing the pumping pressures. If the wellbore 102 is open-hole, a blockage may indicate a collapse of the geological formation 'G."

As illustrated in FIG. 2C, the canopy 108 may be retracted once the logging tool 104 reaches its intended destination. Pumping the carrier fluid 120 (FIG. 2B) may be suspended, and an electrical signal may be transmitted through the wireline 104 to retract the canopy 108. Once the canopy 108 is retracted, the logging tool 104 may be withdrawn from the wellbore 102 by winding the wireline 110 on the winch 116 (FIG. 1).

Figure 3A:
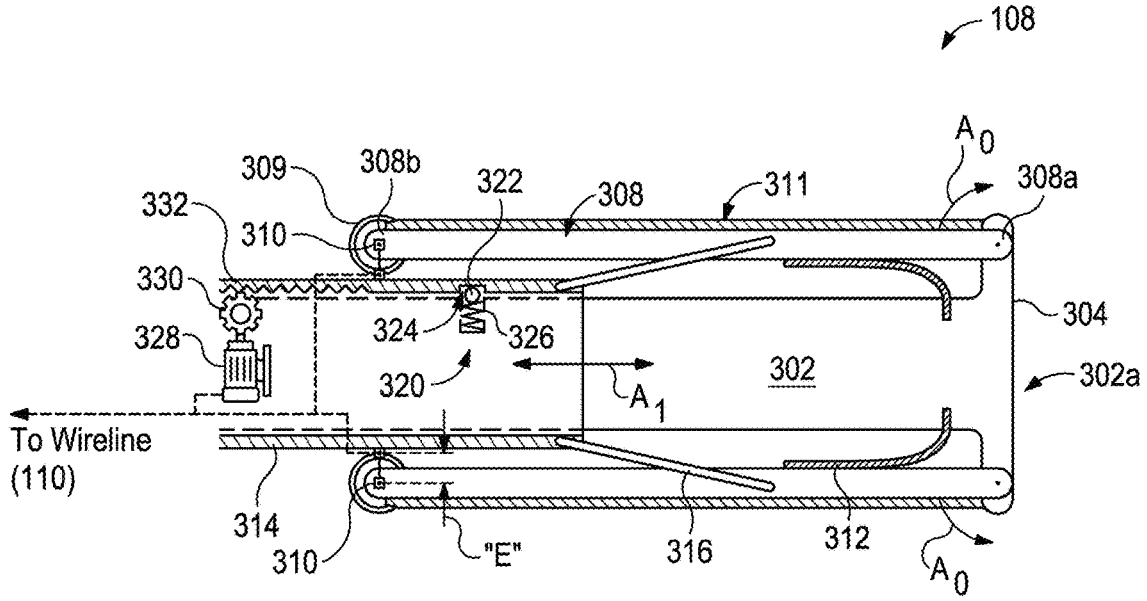
FIGS. 3A and 3B are enlarged schematic views of the canopy in retracted and extended configurations, respectively.

FIG. 3A is a schematic, cross-sectional side view of the canopy 108 in a retracted configuration, according to one or more embodiments. As illustrated, the canopy includes a central shaft 302, which may be fixed in position with respect to the sonde 106 (FIG. 1). A leading end 302*a* of the central shaft 302 may define a radially extending rim 304 to which a plurality of circumferentially-spaced, elongated ribs 308 are pivotably coupled. The ribs 308 define a pivot end 308*a*, which may be pivotally coupled to the rim 304, and a free end 308*b* opposite the pivot end 308*a*. The ribs 308 may be generally rigid and may be constructed of steel rods or similar materials. In some embodiments, one or more wheels 309 may be rotatably supported at the free end 308*b* of each rib 308. The wheels 309 protrude radially from the ribs 308 to guide the logging tool 104 (FIG. 2B) along the wellbore 102.

Also coupled to the free ends 308*b* of the ribs 308 are calipers 310. The calipers 310 are operable to measure a characteristic indicative of an extension distance "E" of the respective rib 308 to which the caliper 310 is attached. The calipers 310 may be communicably coupled to the wireline 110 (FIG. 1) to transmit a signal indicative of the extension distance "E." The calipers 310 may include any type of measurement device recognized in the art.

Flexible panels 311 may be coupled to the ribs 308 and extend circumferentially between the ribs 308 to circumscribe the central shaft 302. The flexible panels 311 may be constructed of a durable material (e.g., an elastomer, a plastic, etc.) that will allow the canopy 108 to extend and retract without shearing (damaging) the panels 311.

A plurality of biasing members 312 are operably coupled between the central shaft 302 and each of the ribs 308 to bias the ribs 308 radially outwardly, e.g., in the pivotal directions of arrows $A_0$. As illustrated in FIG. 3A, the biasing members 312 are configured as leaf springs fixed to the central shaft 302 and engaging the ribs 308 in a slidable manner to permit pivotal movement of the ribs 308 between the retracted configuration of FIG. 3A and an extended configuration illustrated in FIG. 3B. In other embodiments, the biasing members 312 may include coiled wire springs, stacks of Bellville washers, or other types of biasing mechanisms recognized in the art.

The ribs 308 are each coupled to a piston 314 by a linkage 316. The piston 314 is movable longitudinally along the central shaft 302 in the directions of arrows $A_1$, and the ribs 308 are movable in the pivotal direction of arrow $A_0$. Thus, the linkages 316 may be pivotally coupled to both the central shaft 302 and the ribs 308 to accommodate the respective movements of the piston 312 and the ribs 308. As illustrated in FIG. 3A, the piston 314 is in a longitudinally retracted configuration along the central shaft 302 where the linkages 316 maintain the ribs 308 in the radially retracted configuration illustrated. The piston 314 may be selectively maintained in the longitudinally retracted configuration by a locking mechanism 320. The locking mechanism 320 is constructed as a spring-loaded ball plunger with a spherical latch member 322 extending between the central shaft 302 and a notch 324 defined in the piston 314. The spherical latch member 322 is biased by a spring 326 into the notch 324. Other types of locking mechanisms are contemplated including solenoids, electrically activated latches, etc.

An actuator 328 is provided for selectively moving the piston 314 longitudinally along the central shaft 302. The actuator 328 may include an electric motor operably coupled to the wireline 110 (FIG. 1) such that the actuator 328 may receive instructions (command signals) from an operator at the surface location "S." As illustrated in FIG. 3A, the actuator 328 is operably coupled to a pinon gear 330, which may be rotated by the actuator 328 to drive a rack gear 332 in the longitudinal direction of arrows A1. The rack gear 332 is defined on, or otherwise coupled to, the piston 314 such that the piston 314 moves longitudinally along with the rack gear 332.

Figure 3B:
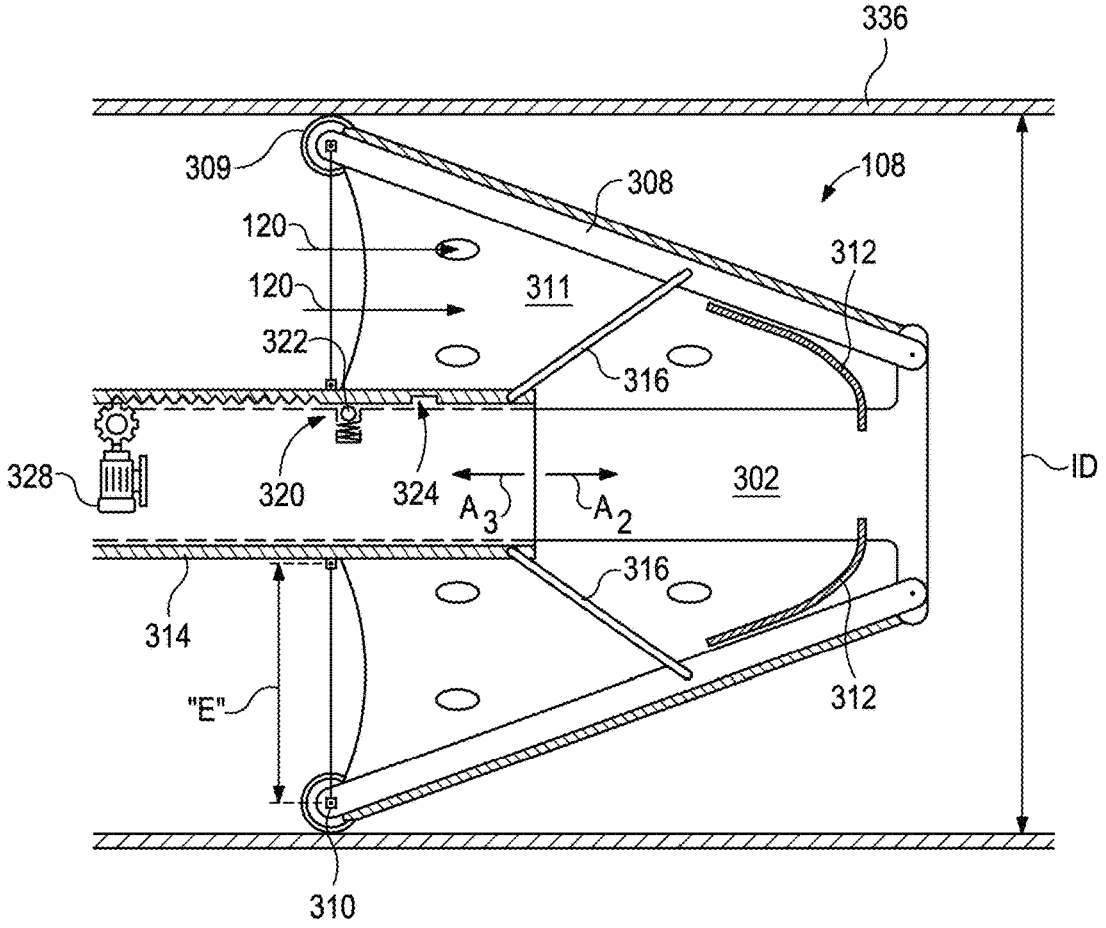

As illustrated in FIG. 3B, the canopy 108 may be moved to an extended configuration where the ribs 308 are pivoted radially outward, and the panels 311 of the canopy 108 are extended. To move the canopy 108 from the retracted configuration of FIG. 3A to the extended configuration of FIG. 3B, the actuator 328 may be instructed to advance the piston 314 along the central shaft 302 in a downhole direction of arrow $A_2$. Once the piston 314 is advanced sufficiently to release the latch member 322 from the notch 324, the locking mechanism 320 releases the piston 314, and the piston 314 may be drawn further in the direction of arrow $A_2$ under the bias of the biasing members 312. The bias of the biasing members 312 may radially extend the ribs 308, and the extension of the ribs 308 draws linkages 316 and the piston 314 generally in the direction $A_2$.

The ribs 308 may extend under the bias of the biasing members 312 until the wheels 309 engage a casing 336, the geologic formation "G" (FIG. 1) or other wellbore wall. The wheels 309 may roll along the casing 336 (or the wellbore wall) and ensure smooth movement of the logging tool 104 (FIG. 1). The calipers 310 may monitor the extension distance "E," from which the inner diameter ID of the casing 336 or wellbore may be determined. The calipers "E" may transmit real-time data indicative of the ID through the wireline 110 to an operator at the surface location "S." The operator may thereby determine whether the inner diameter ID is changing as the logging tool 104 is advanced, whether of the casing 336 or geologic formation "G" is experiencing high axial loads and collapsing, whether a blockage or defect is present only on one side and identify other defects or downhole conditions.

The panels 311 are extended and span between the ribs 308 such that the carrier fluid 120 may be pumped downhole to impinge on the panels 311 and drive the logging tool 104 (FIG. 2B) in the downhole direction. A portion of the carrier fluid 120 passes through the ports 204 and may be injected into the geologic formation "G" (FIG. 1) such that a pumping pressure may be monitored for diagnosing defects in the wellbore 102 (FIG. 2B) as described above. For logging operations conducted in connection with a water injection operation, the carrier fluid 120 may include the water to be injected into the wellbore 102. For logging operations conducted in connection with a hydrocarbon recovery operation, the carrier fluid 120 may include diesel or another fluid that will not damage the formation or the hydrocarbons contained therein. In some embodiments, relatively low pumping rates may be effective for advancing the logging tool 104. For example pumping rates as low as 0.1 through 0.4 barrels per minute may be effective to advance the logging tool 104 downhole.

Once the logging tool 104 reaches its intended destination, the canopy 108 may be returned to the retracted configuration of FIG. 3A to facilitate withdrawal of the logging tool 104 from the wellbore 102. To return the canopy 108 to the retracted configuration, the actuator 328 may be instructed to move the piston 314 along the central shaft 302 in the uphole direction of arrow $A_3$. The piston 314 draws the linkages 316 in the uphole direction, and the linkages 316, in turn, pivot the ribs 308 radially inwardly and compress the biasing members 312. Once the notch 324 reaches the locking mechanism 320, the spherical latch member 322 may again extend into piston to maintain the canopy 108 in the retracted configuration.

Figure 4:
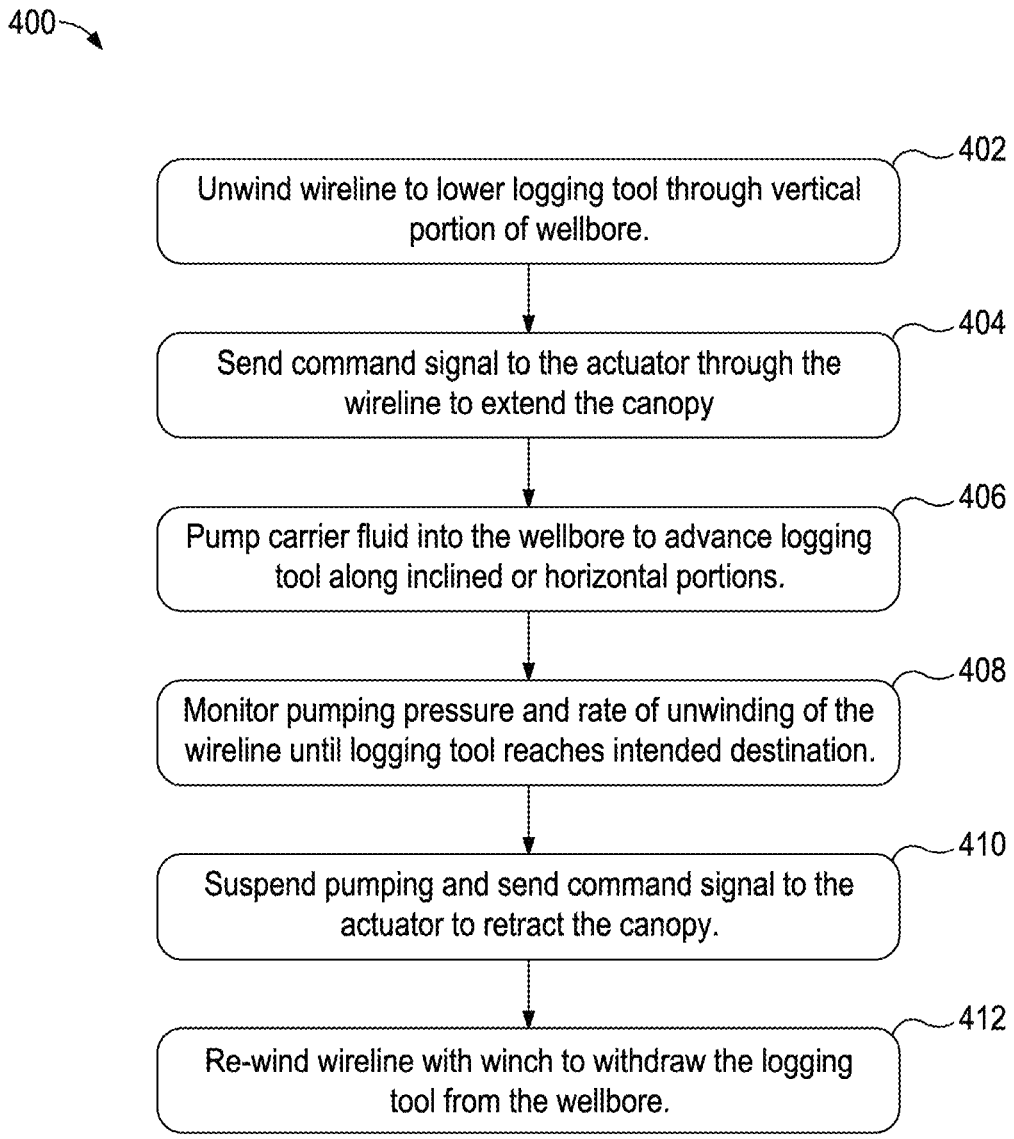
FIG. 4 is flowchart illustrating an example procedure for performing a logging operation with the wireline logging tool of FIG. 1 according to aspects of the present disclosure.

FIG. 4 is flowchart illustrating an example procedure 400 for performing a logging operation with the wireline logging tool according to aspects of the present disclosure. Initially at step 402, the wireline may be unwound from the winch to lower the logging tool through the vertical portion of the wellbore. The logging tool may be lowered with the canopy in a retracted configuration. When the logging tool reaches a portion of the wellbore where frictional contact between the wellbore wall and the logging tool prevents further advancement of the logging tool with gravity alone, slack may be detected in the wireline.

Then, at step 404, a command signal may be sent to the actuator to extend the canopy. The actuator may move the piston, and/or manipulate a locking mechanism to allow the ribs to extend under the influence of the biasing members. The canopy may be extended until the wheels at the free ends of the ribs engage the wellbore wall. Next, at step 406, the carrier fluid may be pumped downhole to impinge on the panels of the canopy and advance the logging tool along inclined or horizontal portions of the wellbore.

As the logging tool is advanced, the pumping pressure may be monitored along with a rate that the wireline is unwinding from the winch (step 408). Additionally, data received from the calipers may be monitored as the logging tool moves through the wellbore. With these characteristics, an operator may be able to identify obstructions the wellbore or other downhole defects.

Once the logging tool reaches an intended destination, the procedure 400 may proceed to step 410. Pumping of the carrier fluid may be suspended and a command signal may be sent through the wireline to the actuator. In response to the command signal, the actuator may retract the piston and reengage the locking mechanism. The ribs will thereby be retracted against the bias of the biasing member and the locking mechanism may maintain the canopy in the retracted configuration. Then, at step 412, the wireline may be wound with the winch and retracted from the wellbore.

Embodiments disclosed herein include:

A. A wellbore logging system can include a wireline extending from a surface location into a wellbore, a sonde coupled the wireline in the wellbore, the sonde including at least one logging instrument for detecting one or more properties of the wellbore or a geologic formation penetrated by the wellbore, as a function of depth and a canopy coupled to the sonde. The canopy can include a central shaft, a plurality of ribs pivotally coupled to the central shaft, a plurality of flexible panels extending between each of the plurality of ribs to circumscribe the central shaft and an actuator operably coupled to the wireline and the plurality of ribs, the actuator responsive to a signal transmitted through the wireline to move the plurality of ribs from a retracted configuration to a radially extended configuration with respect to the central shaft.

B. A method of conducting a logging operation in a wellbore can include (a) lowering a logging tool on a wireline through a vertical portion of the wellbore, (b) transmitting a command signal through the wireline to the logging tool in the wellbore, (c) radially extending a canopy of the logging tool in response to the command signal and (d) pumping a carrier fluid into the wellbore to impinge on the canopy and thereby advance the logging tool along an inclined or horizontal portion of the wellbore.

C. A logging tool can include a sonde including a connector for coupling the sonde to a wireline, the sonde operable to detect one or more properties of the wellbore or a geologic formation penetrated by the wellbore, as a function of depth, a central shaft fixedly coupled to the sonde, a plurality of ribs pivotally coupled to the central shaft, a plurality of flexible panels extending between each of the plurality of ribs to circumscribe the central shaft and an actuator operably coupled to the plurality of ribs to move the plurality of ribs from a retracted configuration to a radially extended configuration with respect to the central shaft.

Each of embodiments A, B, and C may have one or more of the following additional elements in any combination: Element 1: further comprising a plurality of biasing members coupled between the central shaft and the plurality of ribs to bias the plurality of ribs toward the radially extended configuration. Element 2: further comprising a locking mechanism operable to maintain the ribs in the retracted configuration against the bias of the biasing members, and wherein the actuator is operably coupled to the locking mechanism to release the plurality of ribs to extend radially under the bias of the biasing mechanisms. Element 3: further comprising a piston operably coupled to the actuator to move along the central shaft and thereby disengage the locking mechanism to release the plurality of ribs. Element 4: wherein the actuator includes an electric motor operably coupled to piston to move the piston in a first direction to disengage the locking mechanism, and to move the piston in a second direction to retract plurality of ribs and to reengage the locking mechanism. Element 5: wherein the flexible panels are constructed of an elastomeric material including one or more ports defined therethrough. Element 6: further comprising a wheel rotatably coupled to a free end of each of the ribs. Element 7: further comprising a caliper operably coupled to each of the ribs, the caliper operable to detect an extension distance of the rib to which the caliper is coupled and operable to transmit a signal indicative of the extension distance through the wireline. Element 8: further comprising a pump fluidly coupled between a source of carrier fluid and the wellbore, the pump operable to pump the carrier fluid into the wellbore to impinge on the canopy and advance the logging tool in the wellbore.

Element 9: further comprising passing a portion of the carrier fluid through at least one port defined in the canopy and injecting the portion of the carrier fluid into a geologic formation penetrated by the wellbore ahead of the logging tool. Element 10: further comprising monitoring a pumping pressure to detect changes indicative of an obstruction in the wellbore ahead of the logging tool. Element 11: further comprising unwinding the wireline from a winch at a surface location in response to advancing the logging tool along the inclined or horizontal portion of the wellbore and monitoring a speed of the unwinding to detect a loss of movement of the logging tool. Element 12: further comprising engaging a wellbore wall with the canopy in an extended configuration and measuring an extension distance of the canopy in the extended configuration indicative of an inner diameter of the wellbore wall. Element 13: further comprising retracting the canopy in the wellbore and withdrawing the logging tool from the wellbore. Element 14: wherein pumping the carrier fluid includes pumping water into an injection wellbore or injecting diesel into a hydrocarbon producing wellbore.

Element 15: wherein the plurality of flexible panels includes at least one port defined therein for passage of a carrier fluid therethrough in the wellbore. Element 16: further comprising at least one biasing member coupled between the central shaft and the plurality of ribs to bias the plurality of ribs toward the radially extended configuration and a locking mechanism selectively maintaining the plurality of ribs in the retracted configuration against the bias of the at least one biasing member. Element 17: wherein the actuator includes an electric motor operably coupled to a piston to move the piston in a first direction to disengage the locking mechanism, and to move the piston in a second direction to retract plurality of ribs and to reengage the locking mechanism.

By way of non-limiting example, exemplary combinations applicable to A, B, and C include: Element 1 with Element 2; Element 2 with Element 3; Element 3 with Element 4; Element 9 with Element 10; Element 10 with Element 11; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellbore logging system, comprising:

a wireline extending from a surface location into a wellbore;

a sonde coupled the wireline in the wellbore, the sonde including at least one logging instrument for detecting one or more properties of the wellbore or a geologic formation penetrated by the wellbore, as a function of depth; and a canopy coupled to the sonde, the canopy comprising:

a central shaft;

a plurality of ribs pivotally coupled to the central shaft and pivotable between a retracted configuration and a radially extended configuration with respect to the central shaft;

a plurality of flexible panels constructed of a flexible material and circumferentially spanning between each of the plurality of ribs to circumscribe the central shaft, the flexible panels extendable with the plurality of ribs pivoting to the radially extended configuration to thereby expand the canopy into a convex shape circumscribing the central shaft; and an actuator operably coupled to the wireline and the plurality of ribs, the actuator responsive to a signal transmitted through the wireline to move the plurality of ribs from the retracted configuration to the radially extended configuration.

2. The logging system of claim 1, further comprising a plurality of biasing members coupled between the central shaft and the plurality of ribs to bias the plurality of ribs toward the radially extended configuration.

3. The logging system of claim 2, further comprising a locking mechanism operable to maintain the plurality of ribs in the retracted configuration against a first bias of the biasing members, and wherein the actuator is operably coupled to the locking mechanism to release the plurality of ribs to extend radially under the first bias of the biasing members.

4. The logging system of claim 3, further comprising a piston operably coupled to the actuator to move along the central shaft and thereby disengage the locking mechanism to release the plurality of ribs.

5. The logging system of claim 4, wherein the actuator includes an electric motor operably coupled to the piston to move the piston in a first direction to disengage the locking mechanism, and to move the piston in a second direction to retract the plurality of ribs and to reengage the locking mechanism.

6. The logging system of claim 1, wherein the flexible panels are constructed of an elastomeric material including one or more ports defined therethrough.

7. The logging system of claim 1, further comprising a wheel rotatably coupled to a free end of each of the plurality of ribs.

8. The logging system of claim 1, further comprising a caliper operably coupled to each rib of the plurality of ribs, the caliper operable to detect an extension distance of said each rib of the plurality of ribs to which the caliper is coupled and operable to transmit a first signal indicative of the extension distance through the wireline.

9. The logging system of claim 1, further comprising a pump fluidly coupled between a source of carrier fluid and the wellbore, the pump operable to pump the carrier fluid into the wellbore to impinge on the canopy and advance the sonde in the wellbore.

10. A logging tool comprising:

a sonde including a connector for coupling the sonde to a wireline, the sonde operable to detect one or more properties of a wellbore or a geologic formation penetrated by the wellbore, as a function of depth;

a central shaft fixedly coupled to the sonde;

a plurality of ribs pivotally coupled to the central shaft and pivotable between a retracted configuration and a radially extended configuration with respect to the central shaft;

a plurality of flexible panels constructed of a flexible material and circumferentially spanning between each of the plurality of ribs to circumscribe the central shaft, the flexible panels extendable with the plurality of ribs pivoting to the radially extended configuration to thereby expand a canopy coupled to the sonde into a convex shape circumscribing the central shaft; and an actuator operably coupled to the plurality of ribs to move the plurality of ribs from the retracted configuration to the radially extended configuration.

11. The logging tool of claim 10, wherein the plurality of flexible panels includes at least one port defined therein for passage of a carrier fluid therethrough in the wellbore.

12. The logging tool of claim 10, further comprising:

at least one biasing member coupled between the central shaft and the plurality of ribs to bias the plurality of ribs toward the radially extended configuration; and a locking mechanism selectively maintaining the plurality of ribs in the retracted configuration against a first bias of the at least one biasing member.

13. The logging tool of claim 12, wherein the actuator includes an electric motor operably coupled to a piston to move the piston in a first direction to disengage the locking mechanism, and to move the piston in a second direction to retract the plurality of ribs and to reengage the locking mechanism.

* * * * *